United States Patent [19]

Maye

[11] Patent Number: 4,955,607

[45] Date of Patent: Sep. 11, 1990

[54] BASEBALL SPOT PITCHING PRACTICING DEVICE

[76] Inventor: Franklin Maye, 3143 Omega Ave., Simi Valley, Calif. 93063

[21] Appl. No.: 386,271

[22] Filed: Jul. 28, 1989

[51] Int. Cl.[5] ..... A63B 63/00

[52] U.S. Cl. ..... 273/26 A

[58] Field of Search ..... 273/26 R, 55 B, 55 R, 273/402, 26 A, 202, 207, 88

[56] References Cited

U.S. PATENT DOCUMENTS

| | | | |
|---|---|---|---|
| D. 243,782 | 3/1977 | Hickey | D34/5 |
| D. 244,872 | 6/1977 | Staley | D34/5 |
| 422,575 | 3/1890 | Doty | 273/402 |
| 1,258,931 | 3/1918 | Newcomb | 273/402 |
| 1,612,920 | 1/1927 | Hillstrom . | |
| 2,008,359 | 7/1935 | Lamb | 273/402 |
| 2,545,615 | 3/1951 | Hatley | 273/402 |
| 2,580,799 | 1/1952 | Lauterbach | 273/402 |
| 2,873,969 | 2/1959 | Ziel | 273/402 |
| 3,652,085 | 3/1972 | Cole | 273/26 R |
| 3,929,334 | 12/1975 | Magazzu | 273/26 |
| 4,079,939 | 3/1978 | Raistakka | 273/402 |
| 4,097,044 | 6/1978 | Miniere | 273/26 R |
| 4,168,066 | 9/1979 | Sole | 273/402 |
| 4,295,648 | 10/1981 | Stromback | 273/402 |

FOREIGN PATENT DOCUMENTS

| | | | |
|---|---|---|---|
| 345488 | 3/1931 | United Kingdom | 273/398 |

OTHER PUBLICATIONS

Playthings, vol. 56-#6, p. 16, 6/58.

*Primary Examiner*—Theatrice Brown

[57] ABSTRACT

A double loop device for practicing spot pitching which simulates actual game conditions. The device may be positioned on either side of home plate, for example, for practicing inside or outside pitches within the strike zone. The upper loop of the device permits high spot pitches within the strike zone to be practiced, and the lower loop permits low spot pitches within the strike zone to be practiced. The two loops permit the pitcher to practice high and low spot pitches at will without any need to replace or adjust the device, and to mix up the pitches. The device may be formed of metal rods. The loops may be rubber coated to protect the baseballs, and may be coated by bright colored paint.

4 Claims, 1 Drawing Sheet

BASEBALL SPOT PITCHING PRACTICING DEVICE

BACKGROUND OF THE INVENTION

Training devices for improving the throwing accuracy of a baseball are known to the art. Such training devices are shown and described, for example, in U.S. Pat. Nos. 3,039,770; 1,393,408; 3,680,862; 2,647,747; 3,633,909; 3,341,197 and 3,312,467. However, such training devices utilize a single loop, and their use is somewhat impaired insofar as practicing spot pitching of a baseball is concerned.

SUMMARY OF THE INVENTION

A double loop device is provided for practicing spot pitching in the game of baseball. The device may be positioned on either side of home plate, for example, for practicing inside or outside pitches within the strike zone. The upper loop permits high spot pitches within the strike zone to be practiced, and the lower loop permits low spot pitches within the strike zone to be practiced. The two loops permit the pitcher to practice high and low pitches at will, and to mix his pitches.

DETAILED DESCRIPTION OF THE ILLUSTRATED EMBODIMENT

Figure 2:
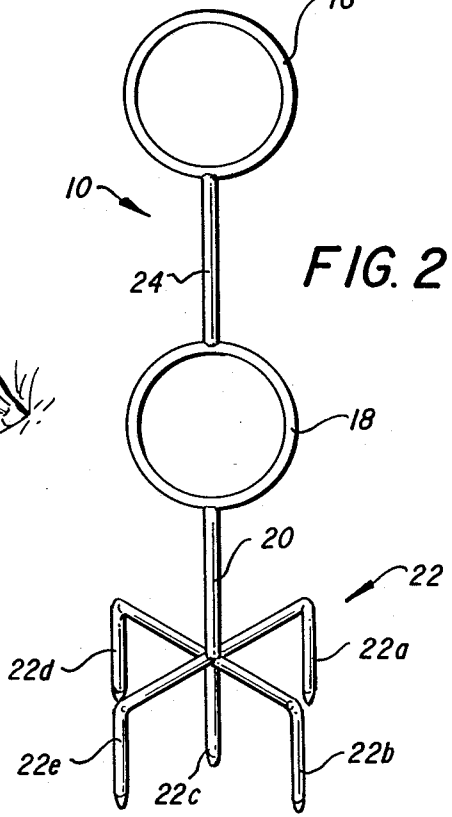
FIG. 2 shows the device of FIG. 1 retracted out of the ground to show the configuration of its supporting base.
Figure 1:
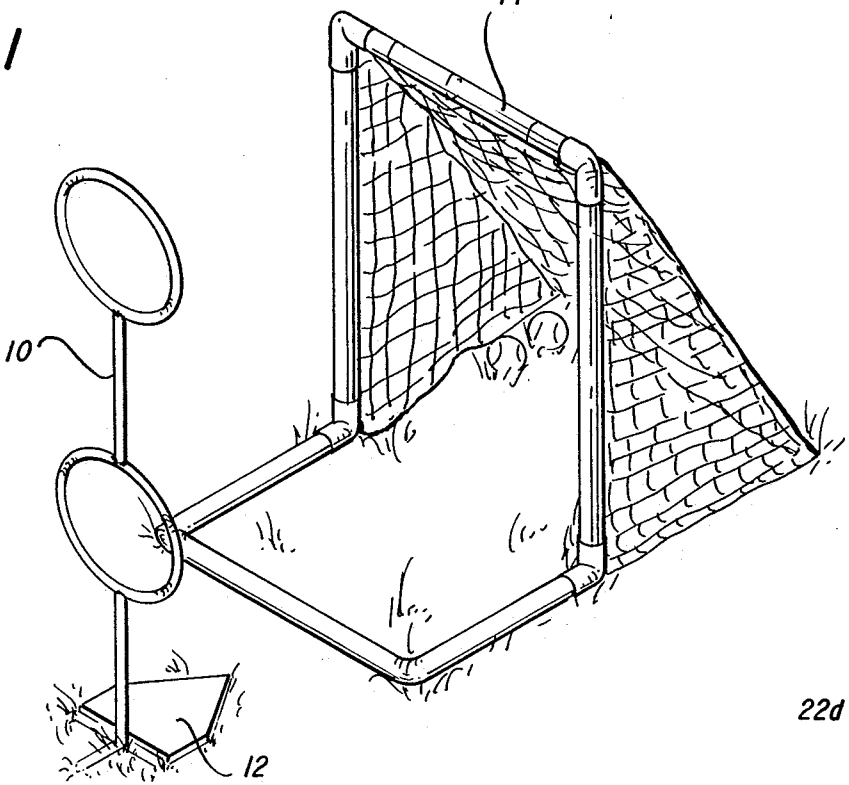
FIG. 1 shows a device constructed in accordance with the invention positioned adjacent to a home plate and in front of a training net.

The spot pitching training device of the invention is designated 10 in FIGS. 1 and 2. The device is shown supported in the ground in FIG. 1 adjacent to a home plate 12. The device is positioned in front of a training net 14 which serves to catch the baseballs thrown through the device.

Although the device is shown in FIG. 1 as mounted on the right side of the home plate 12, it may also be mounted on the left side, so that the pitcher may practice inside pitches and outside pitches.

A feature of the device of the invention is the provision of a pair of loops in the device designated 16 and 18. The lower loop 18 is supported on an upright elongated mounting member 20 which extends upwardly from a supporting base shown generally as 22. A second elongated supporting member 24 is attached to the lower loop, and serves to support the lower loop 18, and serves to support the upper loop 16.

The length of the mounting members 20 and 24 is selected so that when the device is in position, as shown in FIG. 1, the loops 16 and 18 are positioned within the strike zone, but at the upper end and lower end respectively of the strike zone. As mentioned above, the provision of the two loops permits the pitcher to mix his pitches and to practice pitching to the upper end of the strike zone and the lower end of the strike zone at will. As also mentioned, the device may be shifted from one side of home plate to the other, so that the pitcher may practice inside and outside pitches, while still in the strike zone.

As shown in FIG. 2, the supporting base 22 includes a number of elongated members *22a*, *22b*, *22c*, *22d* and *22e* which extend downwardly, and which have pointed ends. These members permit the device to be supported in the ground, merely by pushing the elongated members of the supporting base 22 down into the ground. In this manner, the device may be easily placed beside the plate 12, on either side of the plate, and remove when not in use.

The supporting members 24, as well as the loop members 16 and 18, may all be formed of appropriate rod-like material. It is desirable to coat the loop members 16 and 18 with a rubber-like material, so as to protect the baseballs. Also, it may be desirable to coat the loop member 16 and 18 with a brightly colored coating for aesthetic purposes, and also to make the loops more visible to the pitcher.

It will be appreciated that while a particular embodiment of the invention has been shown and described, modifications may be made. It is intended in the claims to cover all modifications which come within the true spirit and scope of the invention.

I claim:

1. A baseball training device for practicing baseball pitching, said device comprising: A supporting base; a first elongated rod attached to and extending upwardly from said base; a first loop member attached to the upper end of said first elongated rod; a second elongated rod attached to and extending upwardly from said first loop member in axial alignment with said first elongated rod; and a second loop member attached to the upper end of said second elongated rod and facing in the same direction as said first loop member; said first elongated rod having a predetermined length so as to place said first loop at the lower end of a regulating baseball strike zone, and said second elongated rod having a predetermined length so as to place said second loop member at the upper end of said regulation baseball strike zone.

2. The baseball training device defined in claim 1, in which said loop members are coated with a resillient material.

3. The baseball training device defined in claim 1, in which said loop members are coated with a colored paint material.

4. The baseball training device defined in claim 1, in which said supporting base includes a plurality of spikes extending downwardly therefore to be driven into the ground.

* * * * *